US007849799B2

(12) United States Patent
Pervan

(10) Patent No.: US 7,849,799 B2
(45) Date of Patent: Dec. 14, 2010

(54) SUPPLEMENT TO MINES BY WHICH THE TIME PERIOD IS LIMITED WITHIN WHICH THE ACTIVATION OF MINES AFTER THEIR PLACING IS POSSIBLE

(76) Inventor: Boris Pervan, ILICA 106, Zagreb (HR) 10000

( * ) Notice: Subject to any disclaimer, the term of this patent is extended or adjusted under 35 U.S.C. 154(b) by 1156 days.

(21) Appl. No.: 10/595,347

(22) PCT Filed: Oct. 15, 2004

(86) PCT No.: PCT/HR2004/000040

§ 371 (c)(1),
(2), (4) Date: Apr. 11, 2006

(87) PCT Pub. No.: WO2005/036094

PCT Pub. Date: Apr. 21, 2005

(65) Prior Publication Data

US 2007/0101890 A1 May 10, 2007

(30) Foreign Application Priority Data

Oct. 16, 2003 (HR) ..... P 20030841 A

(51) Int. Cl.
*F42C 15/44* (2006.01)

(52) U.S. Cl. ..... 102/426; 102/401; 86/50; 89/1.13

(58) Field of Classification Search ..... 86/50
See application file for complete search history.

(56) References Cited

U.S. PATENT DOCUMENTS 2,426,269 A * 8/1947 Hopkins ..... 102/315
3,115,834 A * 12/1963 Schwarz et al. ..... 102/419
3,175,055 A 3/1965 Klapheke
3,447,461 A * 6/1969 Lapof ..... 102/426
3,513,778 A 5/1970 Heinemann
3,568,601 A * 3/1971 Morrow ..... 102/215
3,667,387 A * 6/1972 Picard et al. ..... 102/426
3,750,527 A * 8/1973 Heinemann ..... 86/1.1
4,046,055 A * 9/1977 McDanolds et al. ..... 86/50
4,711,179 A * 12/1987 Sundberg et al. ..... 102/426
5,373,790 A * 12/1994 Chemiere et al. ..... 102/226

(Continued)

FOREIGN PATENT DOCUMENTS

CN 1085829 C 10/1999

(Continued)

*Primary Examiner*—Troy Chambers
*Assistant Examiner*—Samir Abdosh
(74) *Attorney, Agent, or Firm*—Brooks Kushman P.C.

(57) ABSTRACT

The invention consists of initial part (2B), which at the lower side is made in pyramid form and is part of mine activating mechanism (1). At its screwing into mine body (3), ampoule (D2) containing the aggressive matter is broken by the sharp point, the matter spills and comes to initial part (2B) that gets immersed in it. The aggressive matter slowly corrodes the walls of initial part (2B) and, when it corrodes them through, it mixes with the initial explosive placed inside initial part (2B), soaks it and neutralizes it, in such a way the initial explosive looses its explosive properties, and the mine cannot be activated any more. Cylindrical housing (D) serves for placing ampoule (D2) and retaining the aggressive liquid after breaking ampoule (D2).

12 Claims, 6 Drawing Sheets

U.S. PATENT DOCUMENTS

Figure 1:
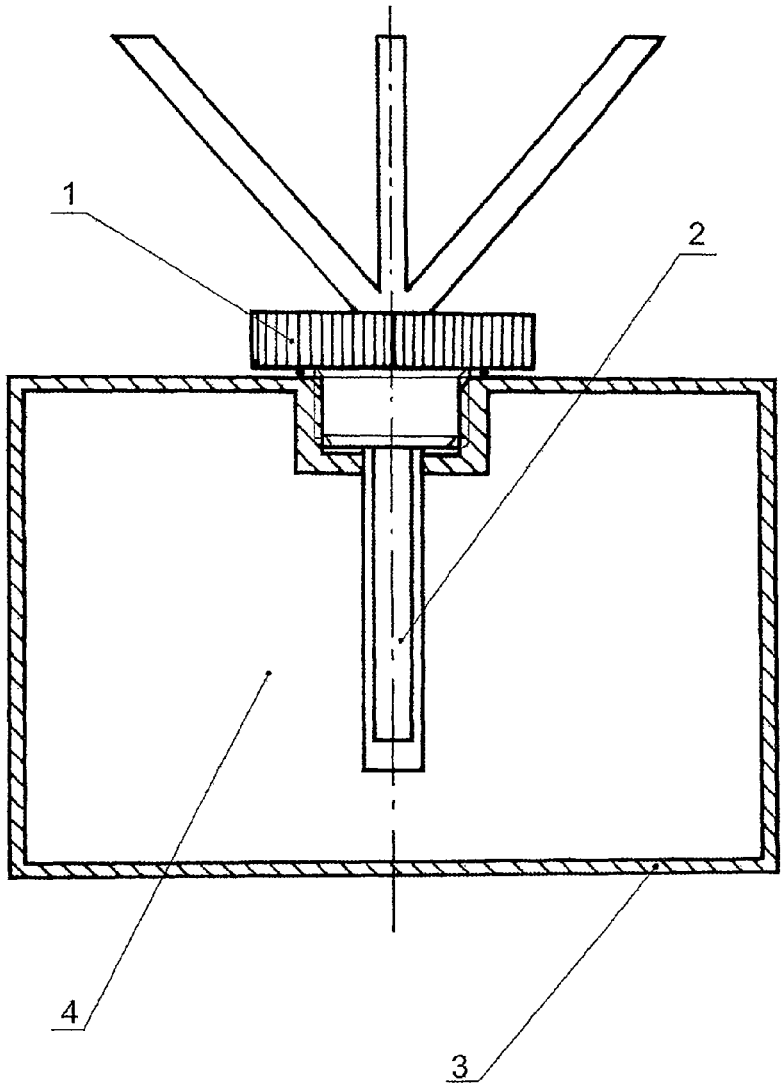

| | | | | |
|---|---|---|---|---|
| 5,423,266 | A * | 6/1995 | Adams | 102/401 |
| 5,714,707 | A * | 2/1998 | Ruia | 86/49 |
| 6,298,763 | B1 * | 10/2001 | Greenfield et al. | 89/1.13 |
| 7,213,518 | B2 * | 5/2007 | Sutcliffe | 102/215 |
| 2004/0107824 | A1 * | 6/2004 | Ferrari et al. | 86/50 |

FOREIGN PATENT DOCUMENTS

| | | | |
|---|---|---|---|
| FR | 2691799 | A | 12/1993 |
| RU | 2154800 | C1 | 8/2000 |

* cited by examiner

Prior Art

SUPPLEMENT TO MINES BY WHICH THE TIME PERIOD IS LIMITED WITHIN WHICH THE ACTIVATION OF MINES AFTER THEIR PLACING IS POSSIBLE

REFERENCE FIELD OF THE INVENTION

This invention is applicable for all kinds of mines, and at its use, when placing the mines, the time period within which it is possible to activate the mines is determined. By the elapsing of this time period the mine activation is disabled, and according to the international classification (IPC) it is classified as:

TECHNICAL PROBLEM

During the wars the enemy armies place the mines in front of their defense lines, aside of them but also in their background. Although a lot of effort is made for the program of forbidding the production and placement of anti-infantry mines, the occupied positions are efficiently protected by the mines, and the objects, roads and possible attack directions of the enemy vehicles are secured; therefore it can be expected that also in the future situations of the war danger various types of mines will be used. At placing the mines the plans of the established mine fields are made, according to which the mines could be evacuated after the war, but some of the plans get lost in the war and some of the mines are placed without being evidenced.

After the war the mines remain hidden and it is necessary to find, deactivate and remove them. This requires a lot of time, money, engaged means and people, because a part of the ground presumably mined can be cleared of mines only manually. During the time before the mine clearing-out is performed, a lot of people, particularly many children meet with an accident. Once a mine is placed, it represents a permanent danger and at present it can be removed only by being destroyed, what is carried out by the use of various machines for mine clearing-out or by a systematic searching of the ground and then by a manual deactivating and finally by removing the discovered mines, at a risk that some of the mines will not be discovered and they remain as an eternal danger.

STATE OF ART

The mines are composed of the body, which comprises all its parts, the explosive, the initial part that initiates the explosive ignition, the mechanical assembly that after the shift or pressure initiates the ignition of the initial part in a mechanical way, and lately also by means of electronic assemblies. After placing and disguising it, from the mines the securer is taken out, and they explode after a shift or pressure is employed on the activating mechanism. The mines have no time limitation, and the possibility of their activating is permanent, therefore it is necessary before all to discover them and then to put in the securer again and finally to remove them or destroy them by the explosion.

EXPOSURE OF THE INVENTION ESSENCE

The primary scope of the invention is

1) To enable, that the placed mines after expiring of a certain time, which length can be regulated, become harmless.
2) To enable the security for the placed underwater mines, which can freely float when getting loose from the mooring.

3) To enable, that the already produced mines are simply modified, so that after the modification their activating possibility is time limited.
4) To enable, that the modification of already produced mines as well as the introduction of new parts in the mine producing is financially acceptable.
5) To prevent the exposure of people and animals from accidents after the termination of war operations.

The secondary scope of the invention is:

1) To increase the mine clearing-out speed after the expiring of the presumed time period.

The further scope of the invention is, that the ground contaminated by the mines can be used after a certain time, what is very essential at the agriculture ground, in the urban parts the return of the population is accelerated and in the industrial zones the industrial activities are actuated.

The next scope is the simple use, safe action and few parts and therefore a cheap production.

Each of the confronted sides hopes for a victory and of possessing the occupied ground, and they know in advance that after the end of the enmity they will face the problem of the mine removing, what will financially burden the country exhausted from the war strains, make difficult the normal life and decelerate the return of the civilians into the area of the war operations. Therefore, it exists a justified interest of both confronted sides that the mines that are placed have the limited time of the deadly effect.

The next scope is, that by the use of the invention, after discovering and taking the mines, it is necessary only to replace the initial part and the ampoule, and the mines can be used again.

By this invention a technical novelty in the mine production is introduced, but it is possible to modify the already made mines in an economically acceptable and simple way. The invention enables, that, after placing the mines, the time within which the mine could be activated is limited and after that it becomes harmless, and this possibility of the mine activating time limitation did not exist until now, and in such a way a technical novelty is introduced in relation to the preceding state of art.

SHORT DESCRIPTION OF DRAWINGS

FIG. 1 Side cross-section of the "classical" anti-infantry mine.

Figure 2:
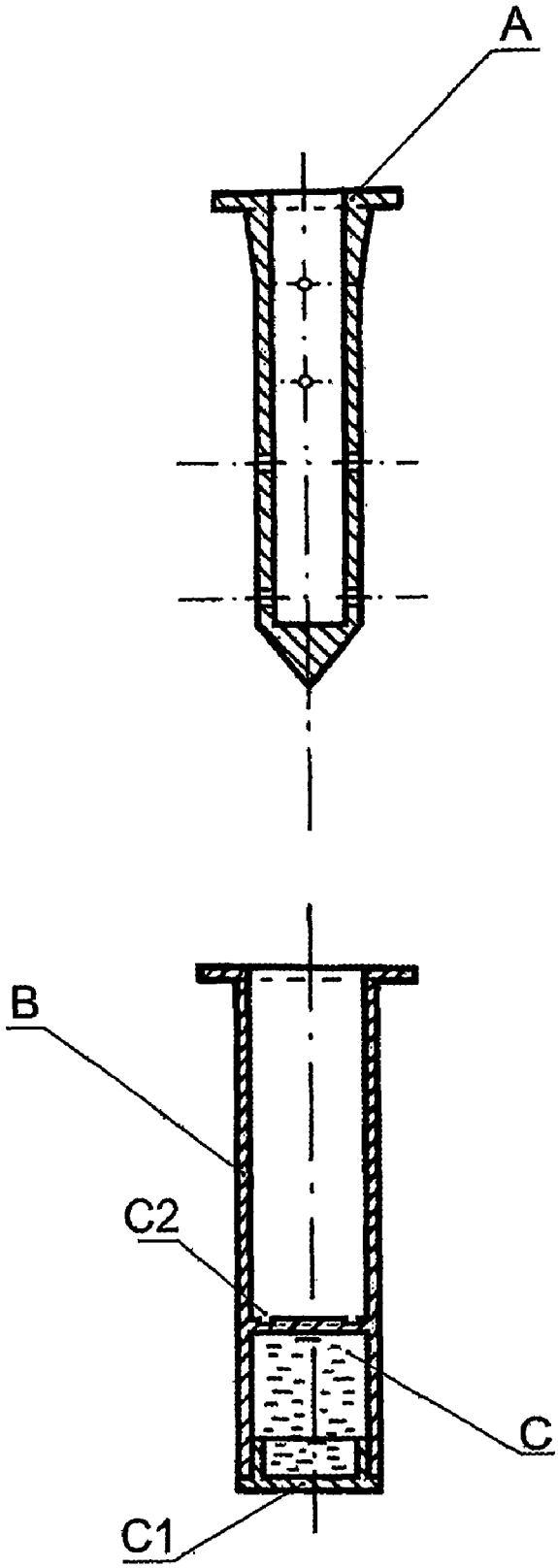

FIG. 2 Side cross-section of the invention parts, by which the time period is limited within which it is possible to activate the placed mine, assigned for installing in the existing mines, version A.

Figure 3:
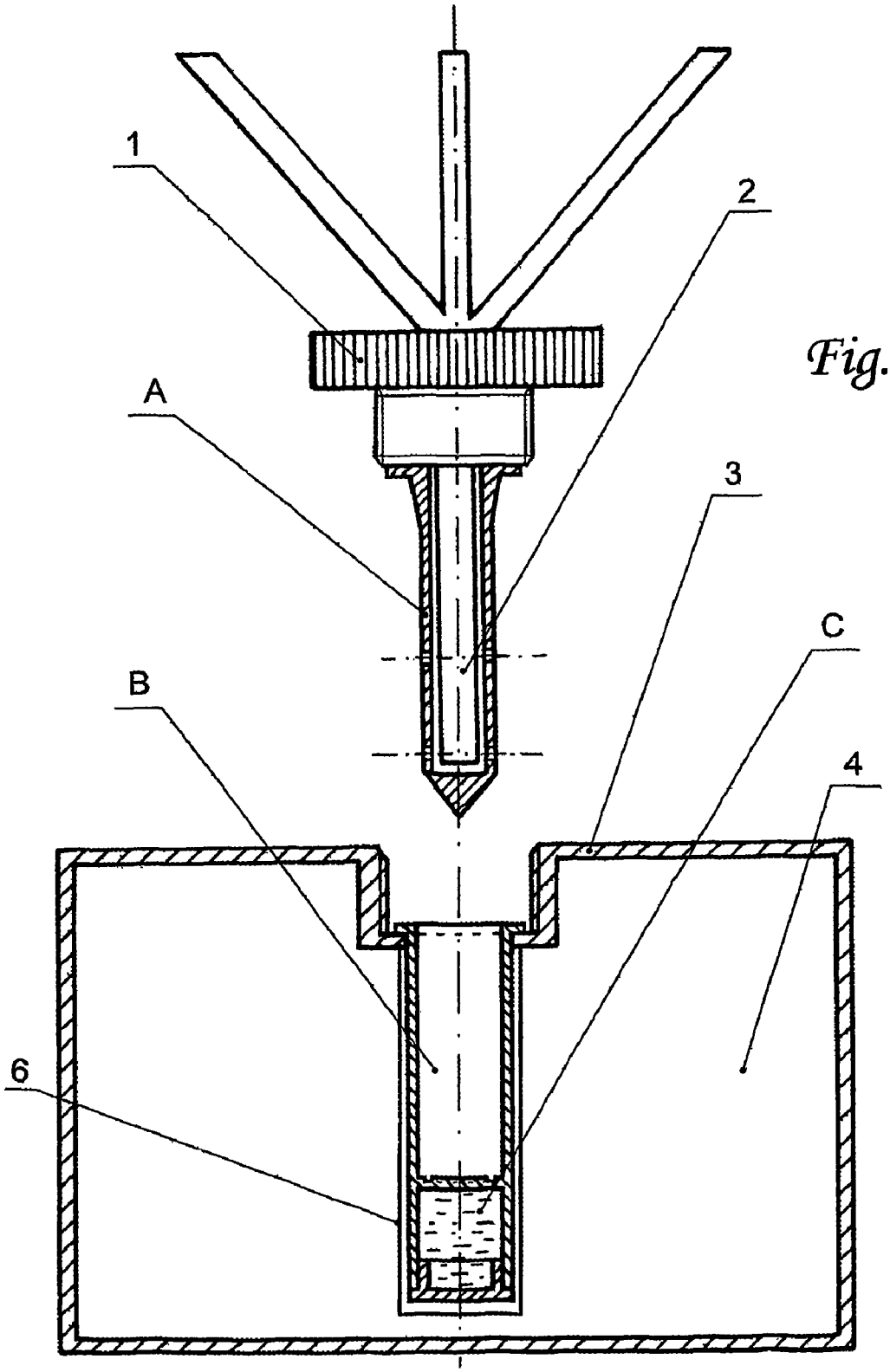

FIG. 3 Side cross-section of the invention by which the period is limited within which the activating of the placed mine is possible, assigned for installing in the existing mines (version A), placed on the position before the fuse is put into the mine.

Figure 4:
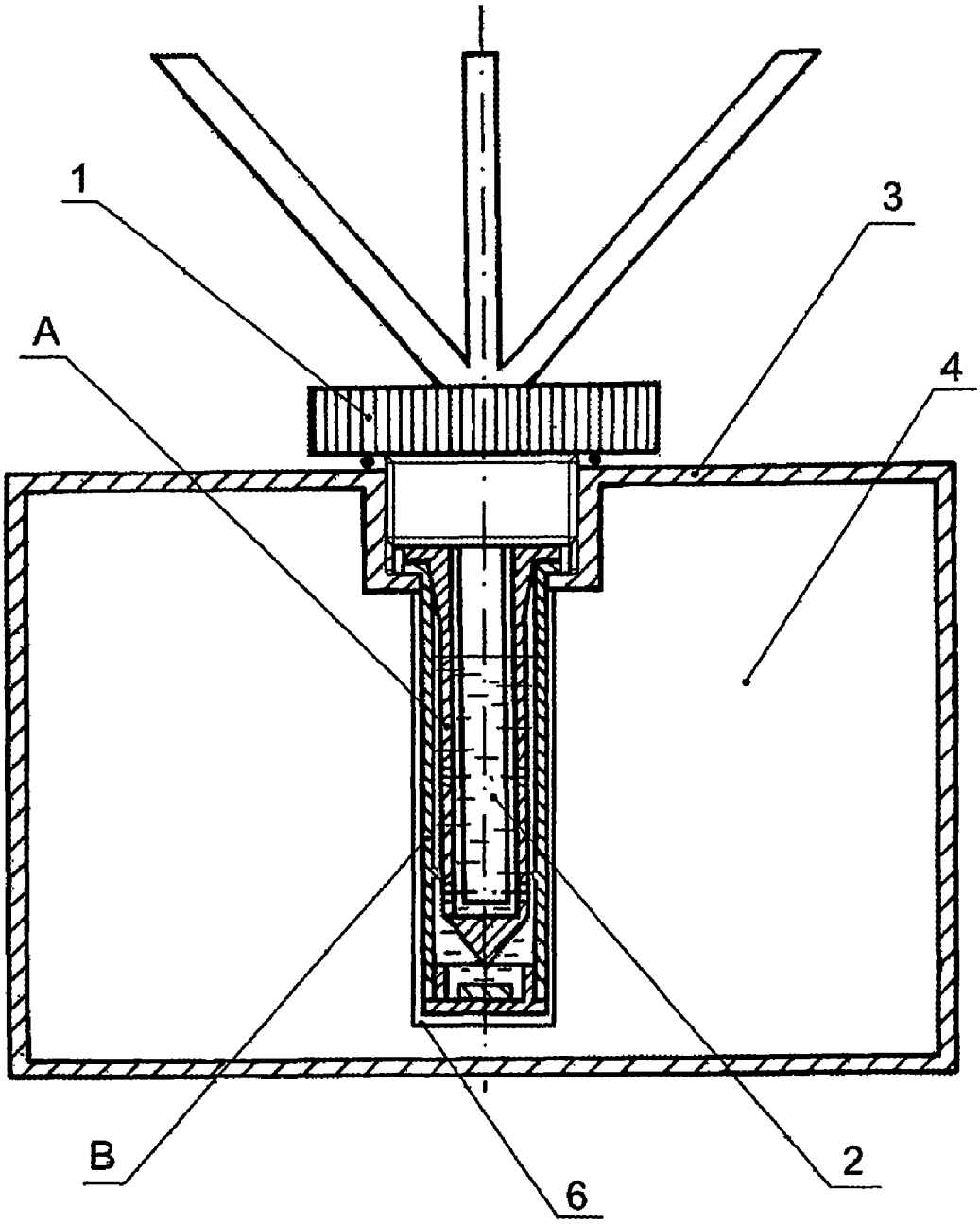

FIG. 4 Side cross-section of the invention, by which the time period is limited within which the activating of the placed mine is possible, assigned for installing in the existing mines (version A) after putting the fuse into the mine.

Figure 5:
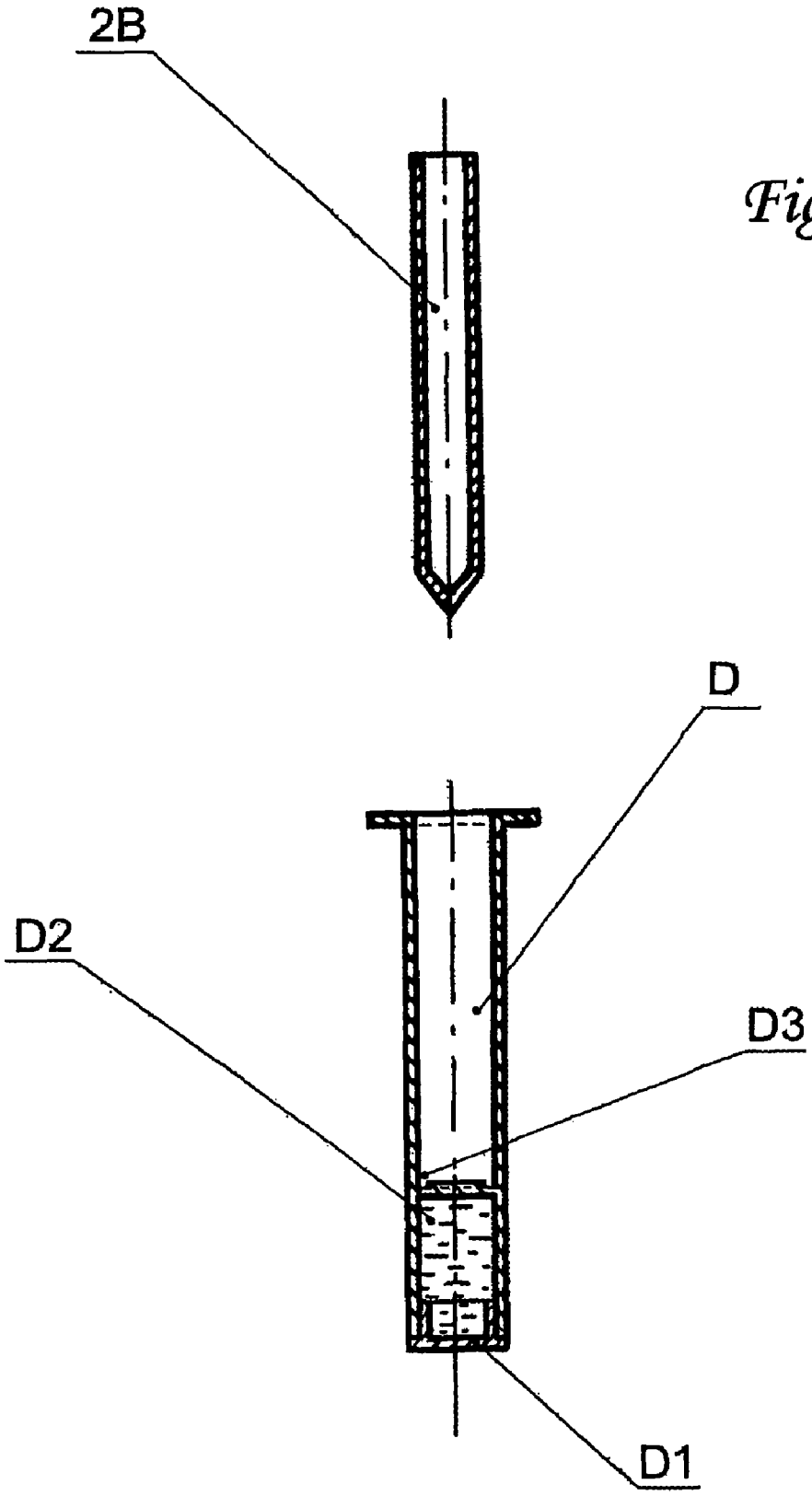

FIG. 5 Side cross-section of the invention parts, by which the time period is limited within which the activating of the already placed mine is possible, assigned for new made mines, version B.

Figure 6:
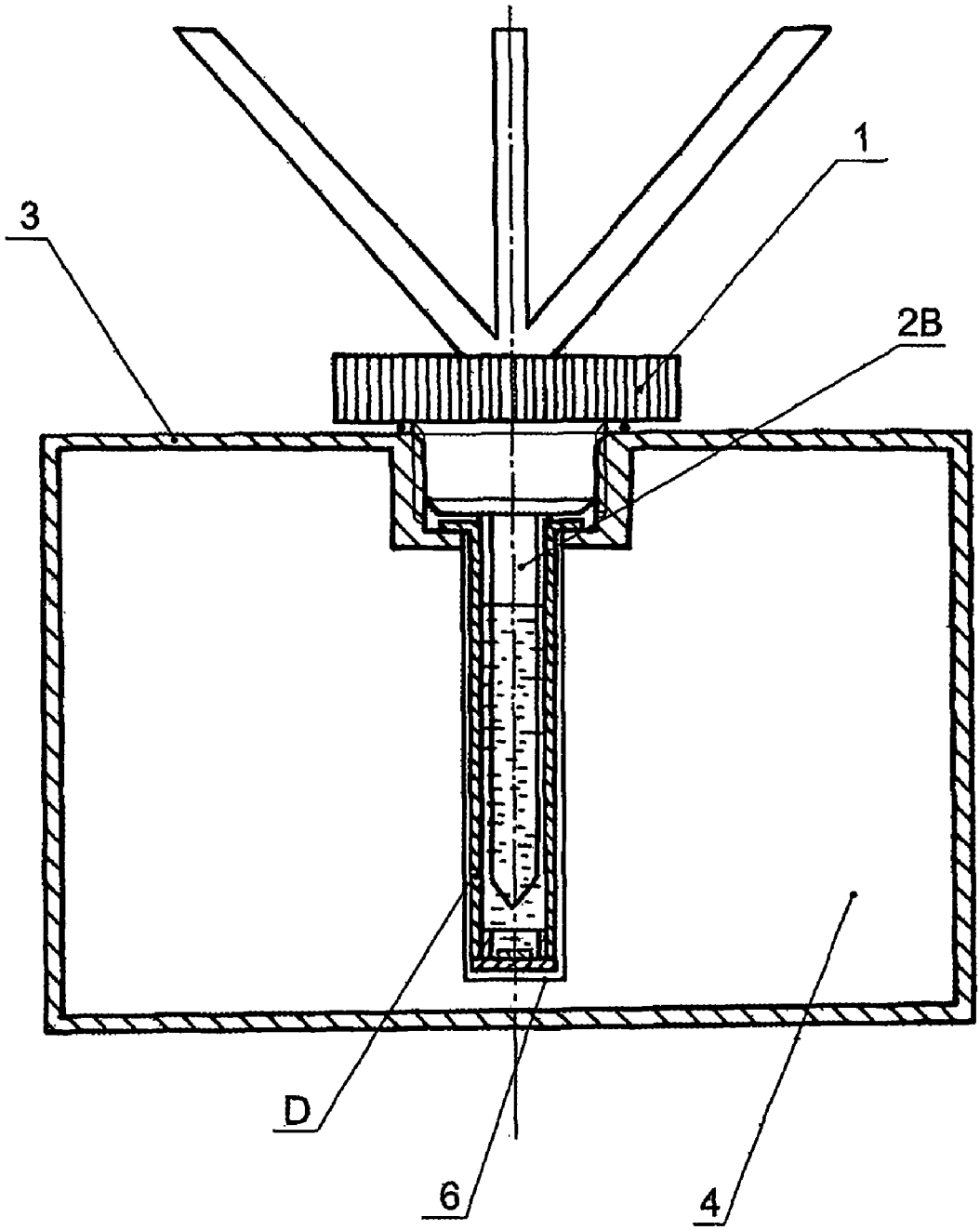

FIG. 6 Side cross-section of the invention, by which the time period is limited within which the activating of the placed mine is possible, assigned for new made mines (version B) after putting the fuse into the mine.

DETAILED DESCRIPTION OF THE INVENTION REALISATION

Mines are composed of mine body (3) inside of which there is explosive (4) (usually cast), initial part (2) by which the ignition of the explosive filling is initiated, and of activating mechanism (1) by which initial part (2) is ignited. Initial part (2) or initial cap is filled with a small amount of explosive matter, which is easily initiated to an explosion and which explosion is sufficiently strong to provoke the ignition and explosion of explosive (4) in mine body (3). Explosive (4), by which mine body (3) is filled, is resistant to self-ignition, and it's explosion can be initiated only by the explosion of some other explosive that is activated in direct proximity or is placed inside of it. As the mine explosive filling usually trinitrotoluol is used, which is melt on a temperature between 80° and 90° Celsius and filled into mine body (3). It is very resistant, and its explosion can be provoked neither by the fire nor by the pressure or bullet. Its explosion is initiated by the explosion of initial part (2). Initial part (2) consists of a cylindrically shaped body closed at the lower side, made of aluminium or sometimes also of plastics and filled with highly sensitive explosive, which explosion is easily accomplished. Usually, for the filling the quicksilver fulminate is used. The initial explosives are in powdery state and, in contact with some liquids or matters; its explosive property is neutralized. The invention is based on that property of the initial means.

Version A

Invention by which the time period is limited within which the activating of the already placed mine is possible, and which is assigned for installing in the existing mines The invention consists of: little pipe with sharp point (A) of cylindrical shape with a hat shaped widening on its upper end, and by this hat it leans against the body of the ignition mechanism, at the lower side it is made in the form of a sharp point and along the wall it has the openings; cylindrical housing (B) having on the upper part a hat shaped widening, and by this hat it leans against the bore in mine (6), on its bottom it has made a container for the aggressive liquid, ampoule (C) filled with the aggressive matter (add, alkali, salt or gel), and after being filled it is closed at the lower side by disc shaped cover (C1).

The invention works in the following way: before placing the ignition mechanism into the mine, into bore (6) for placing the ignition mechanism cylindrical housing (B) is set, on which bottom there is ampoule (C) filled with the aggressive matter. On ignition mechanism (1) little pipe with the sharp point (A) is placed, which completely embraces initial part (2). When activating mechanism (1) is screwed into mine body (3), little pipe with the sharp point (A) is lowered to ampoule (C) filled with the progressive matter, presses it and breaks its upper wall, which is for an easier breaking thinned by annular groove (C2).

The aggressive matter exits from broken ampoule (C) and fills the space of cylindrical housing (B), where now also little pipe with the sharp point (A) is placed and inside of which initial part (2) is placed. The aggressive matter passes through the openings on little pipe with the sharp point (A), comes to initial part (2) that is now immersed into the aggressive matter that starts to corrode it. The time necessary for the corroding-through of the body wall of initial part (2) by the aggressive matter is determined by the concentration of the aggressive matter, so that its higher concentration reduces the time for corroding-through the body of initial part (2). When the aggressive matter corrodes through the body of initial part (2), it comes to the initial explosive placed inside of it, soaks it, and in that instant the initial mixture is not explosive any more and the mine cannot be activated any more.

The time period of the mine activating is determined by the concentration of the aggressive matter that fills ampoule (C). At the filling of ampoule (C), the filling of various concentrates or various kinds of aggressive matter can be chosen, what results in a longer or shorter mine activating time period.

Little pipe with the sharp point (A) is made with a conical widening in its upper part and, during the activating mechanism (1) screwing into mine body (3), little pipe with the sharp point (A) enters into cylindrical housing (B), so that its conical widening is pressed into conical widening (B), and by that the impermeability is secured and the undesired leaking or evaporating of the aggressive liquid spilled after the breaking of ampoule (C) is prevented.

Version B

Invention by which the time period is limited within which the activating of the already placed mines is possible, and which is assigned for new made mines The invention consists of: initial part (2B) of cylindrical shape and at the lower side made in the form of a sharp point; cylindrical housing (D) having on its upper part a hat shaped widening by which it leans against bore (6) in the mine and on its bottom a formed container for the aggressive matter, ampoule (D2) that is filled with the aggressive matter (acid, alkali, salt or gel) and after the filling it is closed at the lower side by disc shaped cover (D1).

The invention works in the following way: in bore (6) cylindrical housing (D) is placed, on which bottom there is ampoule (D2) filled with the aggressive matter. On ignition mechanism (1) there is initial part (2B) filled with initial mixture by which ignition the ignition of explosive (4) is initiated. When ignition mechanism (1) is screwed into mine body (3), initial part (2B) enters into cylindrical housing (D), descends to the ampoule (D2) filled with aggressive matter, presses on it and breaks its upper wall that is for an easier breaking thinned by annular groove (D3).

The aggressive matter exits from broken ampoule (D2) and fills the space of cylindrical housing (D), inside of which there is also initial part (2B), and the aggressive matter starts to corrode the walls of initial part (2B). The time necessary for corroding-through the body walls of initial part (2B) is determined by the concentration of the aggressive matter, so that its higher concentration reduces the time that is necessary for the body of initial part (2B) to be corroded through. When the aggressive matter corrodes through the body of initial part (2B), it comes to the initial explosive placed inside it, soaks it and in that instant the initial mixture in not explosive any more, and the mine cannot be activated any more.

The time period of the mine activation is determined by the concentration of the aggressive matter by which ampoule (D2) is filled. At the filling of ampoule (D2), the filling of various concentrates or various kinds of aggressive matter can be chosen, what results in a longer or shorter mine activating time period.

By this invention in two versions, the time period is limited within which the mines can be activated after they have been placed. For that, in the time period where the activating is permitted, the mines retain all their present characteristics: the safety at placing, the disturbless and safe activating and the same level of the possible detection by various systems for the mine detection. After the expiring of the presumed time period, which can be changed as desired (to determine the longer or shorter time period within which it is possible to activate the mines), it is not possible to activate the mines any more and they become harmless.

INVENTION APPLICATION WAY

The invention is applicable for all kinds of mines and assigned for limiting the time period within which it is possible to activate the mines after being placed.

The part of this invention can be produced in series by a simple industrial procedure.

The invention claimed is:

1. An activating assembly for a mine comprising:

an initializing part configured to contain an explosive substance and adapted to be attached to a mine, the initializing part having at least one surface formed of a material that may be corroded; and a housing configured to receive the initializing part, the housing having an ampoule containing an aggressive substance;

wherein when the initializing part is received in the housing, the ampoule releases the aggressive substance so that the aggressive substance at least partially contacts the surface of the initializing part and the surface corrodes after a predetermined period of time, the explosive substance therein mixing with the aggressive substance and neutralizing the explosive substance thereby disabling the initializing part.

2. The activating assembly of claim 1, wherein the ampoule further comprises a bottom surface capable of being sealed after the ampoule is filled with the aggressive substance.

3. The activating assembly of claim 1 wherein the ampoule further comprises a top surface having an annular groove which facilitates breaking when ampoule is contacted by the initializing part.

4. The activating assembly of claim 1 further comprising a pipe adapted to be received within the housing, the pipe providing protection to the initializing part.

5. The activating assembly of claim 4 wherein the pipe is disposed between the initializing part and the ampoule, the pipe configured to contact and break the ampoule and allow the aggressive substance to contact the surface of the initializing part.

6. The activating assembly of claim 4 wherein the pipe further comprises an upper surface, the upper surface configured to seal against the housing thereby preventing the aggressive substance from being released from the activating assembly.

7. The activating assembly of claim 1 wherein the ampoule is located adjacent a bottom of the housing.

8. The activating assembly of claim 1 wherein the predetermined time may be adjusted by varying a concentration of the aggressive substance.

9. A time-limited mine comprising:

a mine body configured to contain an explosive and having a bore with an ampoule disposed therein, the ampoule containing a aggressive substance; and an activating assembly including an initializing part configured to contain an initiating explosive substance and adapted to be received by the bore, the initializing part having at least one surface formed of a material that may be corroded by the aggressive substance;

wherein when the initializing part is received in the bore, the ampoule releases the aggressive substance so that the aggressive substance at least partially contacts the surface of the initializing part and the surface corrodes after a predetermined period of time, the initiating explosive substance therein mixing with the aggressive substance and neutralizing the initiating explosive substance thereby disabling the activating assembly and deactivating the mine.

10. The mine of claim 9 further comprising a pipe adapted to be received within the bore, the pipe providing protection to the initializing part.

11. The mine of claim 10 wherein the pipe is disposed between the initializing part and the ampoule, the pipe configured to contact and break the ampoule and allow the aggressive substance to contact the surface of the initializing part.

12. The mine of claim 10 wherein the pipe further comprises an upper surface, the upper surface configured to seal against the mine body thereby preventing the aggressive substance from being released from the activating assembly.

* * * * *